United States Patent [19]

Davitz

[11] Patent Number: 5,019,335

[45] Date of Patent: May 28, 1991

[54] GOLD COLORED METAL ALLOY

[76] Inventor: Daniel Davitz, 921 Harlem, Glenview, Ill. 60025

[21] Appl. No.: 377,575

[22] Filed: Jul. 10, 1989

[51] Int. Cl.[5] ..... C22C 9/00; C22C 9/04; C22C 9/06

[52] U.S. Cl. ..... 420/481; 420/485

[58] Field of Search ..... 420/481, 485

[56] References Cited

U.S. PATENT DOCUMENTS

| | | | |
|---|---|---|---|
| 2,067,307 | 1/1937 | Wilkins | 420/481 |
| 2,141,156 | 12/1938 | Petterson | 420/481 |
| 2,229,622 | 1/1941 | Bunn | 420/481 |
| 2,236,452 | 3/1941 | Rogers | 420/481 |
| 2,309,101 | 1/1943 | Crampton et al. | 420/481 |
| 2,445,868 | 7/1948 | Berwick | 420/481 |
| 2,849,310 | 8/1958 | Waller | 420/481 |
| 3,141,799 | 7/1964 | Brellier et al. | 420/481 |
| 3,372,026 | 3/1968 | Christine | 420/481 |
| 3,403,997 | 10/1968 | Badia | 420/481 |
| 4,362,579 | 12/1982 | Tsuji | 420/481 |

FOREIGN PATENT DOCUMENTS

| | | | |
|---|---|---|---|
| 1092218 | 11/1960 | Fed. Rep. of Germany | 420/481 |
| 2311400 | 12/1974 | Fed. Rep. of Germany | 420/485 |
| 0216256 | 12/1984 | German Democratic Rep. | 420/481 |
| 39-20655 | 9/1964 | Japan | 420/481 |
| 55-148739 | 11/1980 | Japan | 420/485 |
| 56-69339 | 6/1981 | Japan | 420/481 |

OTHER PUBLICATIONS

Thews, "Melting and Casting of German Silver Alloys", FIAT Final Report 878, Office of Military Government for Germany (US), Jul. 23, 1946, p. 18.

*Primary Examiner*—R. Dean
*Assistant Examiner*—David W. Schumaker
*Attorney, Agent, or Firm*—Robert S. Beiser

[57] ABSTRACT

The present invention provides an improved casting alloy for use in costume jewelry and jewelry samples. In accordance with the present invention, a gold colored metal alloy is disclosed which is tarnish resistant and consists of the following ingredients such as, 75 to 85% copper, 5 to 15% nickel, 0 to 12% indium, and 0 to 12% zinc. It is also desirable to add approximately 0.01% iron and/or 0.05% silicon to act as a grain refiner and fluidity enhancer respectively. The alloy in accordance with the subject invention is a rich gold color which approximates a fourteen carat alloy. In addition, tarnish resistance and workability is greatly increased.

10 Claims, No Drawings

GOLD COLORED METAL ALLOY

BACKGROUND OF THE INVENTION

1. Field of the Invention

The present invention provides an improved casting alloy for use in costume jewelry and jewelry samples.

2. Prior Art

Gold is generally alloyed with other metals for such use and requires a relatively low melting point. The alloys must be moldable and castable with a low surface tension to permit conformance to intricate molds. Such alloys should provide a material which does not easily corrode or tarnish, especially when used in jewelry.

It is basic that gold is one of the most valuable metals, and the look of gold is a highly desired characteristic of any metal alloy.

In accordance with this invention, an alloy is provided which contains no gold, and yet which provides an alloy material that polishes, works and looks like gold. Also, the alloy of this invention can be tarnish and corrosion resistant in the manner of gold in an ammonia or chlorine solution.

The alloy of this invention may resemble 14 carat gold in color and be highly corrosion resistant equal or superior to lower gold alloys, even though the alloy of this invention has zero percent gold in the preferred embodiment.

In attempts of the prior art to develop a metal alloy possessing the true color of gold, while maintaining its capabilities of being readily workable and polished, various non-precious metals and gold have been tried. For example, the present applicant's U.S. Pat. No. 4,350,527 is directed to a gold colored alloy, having zero to ten percent gold content with seven to twenty percent copper, fifteen to twenty percent indium, and five to fifteen percent palladium. The alloy of '527 teaches zero to ten percent gold. However, '527 requires the use of silver, and does not disclose the unexpected marked increase in gold color caused by the combination of a high percentage of copper in the presence of nickel.

SUMMARY OF THE INVENTION

Accordingly, an object of the present invention is to provide a corrosion resistant, and tarnish resistant alloy which simulates the color of gold colored alloys without the use of gold.

An additional object of the present invention is a metal alloy having chemical and physical properties suitable for use in jewelry.

An additional object of the present invention is a metal alloy having enhanced tarnish and corrosion resistance provided by the use of a high concentration of copper in the presence of nickel, while still maintaining a rich gold appearance.

Still a further object of the present invention is a gold colored metal alloy which is tarnish and corrosion resistant, and has a rich gold appearance with a markedly reduced cost due to the absence of gold content.

Other objects of the present invention and advantages accruing therefrom will be apparent to one skilled in the art in the following detailed description. All percentages referred to are percent by weight based on the total weight of the material or mixture then referred to.

DETAILED DESCRIPTION OF THE PREFERRED EMBODIMENT

In accordance with the present invention, a gold colored metal alloy is disclosed which is tarnish resistant and consists of the following ingredients: 75 to 85% copper, 5 to 15% nickel, 0 to 12% indium, and 0 to 12% zinc. It is also desirable to add approximately 0.01% iron and/or 0.05% silicon to act as a grain refiner and fluidity enhancer respectively. The alloy in accordance with the subject invention is a rich gold color which approximates a 14 carat alloy. In addition, tarnish resistance and workability is greatly increased.

As mentioned above, in the present alloy, no gold is present. Despite the zero percent gold content, the alloy possesses a rich gold color which approximates a 14 carat alloy, casts like a 14 carat alloy, and maintains a high tarnish resistant, even in the presence of such a high percentage of copper. Ordinarily, it would be expected that an alloy with such a high concentration of copper would easily tarnish, and therefore would not be suitable for jewelry. However, it was unexpectedly found that the addition of nickel to such a high percentage of copper makes the alloy very tarnish resistant. Additionally, it was unexpectedly found that nickel when added to a high percentage of copper, enhances the working properties of the alloy by preventing brittleness and increasing hardness.

The copper is used principally as the base element of the alloy, and gives the alloy its rich color. As mentioned above, nickel in the appropriate percentage increases the tarnish resistance and enhances the working properties. A percentage of zinc and indium can be used separately or in combination to lower the melting temperature of the alloy, and also to make the alloy harder. Zinc and indium can also be used to control the color of the alloy, in that zinc tends to lighten the copper color to a more yellow appearance while indium tends to darken the color to a more copperish appearance. A small amount of iron and 0.01% boron for aggregation, is used as a grain refiner and deoxidizer which keeps the grain structure from growing. This serves the purpose of preventing brittleness. Additionally, a small amount of silicon can be added to enhance the alloys fluidity.

In an alternative embodiment, gold may be added in concentrations ranging from one to twenty percent. The addition of gold would not necessarily improve the appearance of the alloy, however, the tarnish and corrision resistance would be much higher. Additionally, the inclusion of gold in the alloy would improve the wearability of the alloy so that it could be cast for high fashion jewelry.

The casting temperature of the present invention described is approximately 1950° Fahrenheit ±50, and the melting temperature is approximately 1775° Fahrenheit ±50. Such temperatures are sufficiently low to permit the formation of a melt and easy casting. The specific gravity of the preferred alloy is approximately 8.35 grams per cubic centimeter ±0.50. Other physical properties of the alloy of the present invention are approximately as follows: low hardness 140, high hardness 160, elongation 10 to 15%. Specifically, the preferred alloy formula in accordance with this invention is: copper 78.94%, nickel 10%, indium 5.5%, zinc 5.5%, iron 0.01%, silicon 0.05%. Because of the presence of copper and nickel in the percentages disclosed in this invention, the alloy becomes highly tarnish and corrosion resistant in an ammonia or chlorine solution. Jewelry or other metal formations cast from the alloy disclosed herein, can be cleaned without fear of tarnishing which is unusual for a copper alloy.

While the invention has been described with reference to a preferred content and formula, it will be understood by those skilled in the art that various changes may be made and equivalence substituted for elements described herein without departing from the scope of the invention. In addition, many modifications may be made to adapt to a particular situation or material to the teachings of the invention without departing from the essential scope thereof. Therefore it is intended that the invention not be limited to the particular embodiment disclosed as the best mode contemplated for carrying out this invention, but that the invention will include all embodiments falling within the scope of the amended claims.

I claim as my invention:

1. A gold color, highly tarnish and corrosion resistant metal alloy which consists essentially of by weight 75 to 85% copper, 5 to 15% nickel, at least 1% indium and the balance consisting essentially of indium.

2. A gold color, highly tarnish resistant metyal alloy which consists essentially of by weight 75 to 82% copper, 5 to 15% nickel, 1 to 12% indium, and 0 to 12% zinc.

3. The alloy of claim 2, having a casting temperature of approximately 1950° Fahrenheit ±50° Fahrenheit.

4. The alloy of claim 2, having a melting temperature of approximately 1775° Fahrenheit ±50° Fahrenheit.

5. The alloy of claim 2 and further comprising approximately by weight 0.01% iron for grain refining.

6. The alloy of claim 2, wherein said alloy has a specific gravity of approximately 8.35 grams per cubic centimeter ±0.50.

7. The alloy of claim 2, and further comprising 1 to 20% by weight gold.

8. The alloy of claim 2, wherein said alloy is gold free.

9. A gold color, highly tarnish resistant metal alloy which consists essentially of by weight 75 to 82% copper, 5 to 15% nickel, 0 to 12% indium, 0 to 12% zinc, and further comprises approximately by weight 0.01% silicon for enhanced fluidity.

10. An article of jewelry made of an alloy consisting essentially of approximately by weight 78% copper, approximately 12% nickel, approximately 5% zinc, and approximately 5% indium.

* * * * *